US007684579B2

(12) United States Patent
Ochsenbein et al.

(10) Patent No.: US 7,684,579 B2
(45) Date of Patent: Mar. 23, 2010

(54) CONNECTOR SYSTEM FOR RECEIVERS OF HEARING DEVICES

(75) Inventors: André Lucien Ochsenbein, Wolfhausen (CH); Daniel Müller, Zürich (CH)

(73) Assignee: Phonak AG, Stafa (CH)

( * ) Notice: Subject to any disclaimer, the term of this patent is extended or adjusted under 35 U.S.C. 154(b) by 1052 days.

(21) Appl. No.: 11/348,138

(22) Filed: Feb. 6, 2006

(65) Prior Publication Data

US 2007/0183612 A1 Aug. 9, 2007

(51) Int. Cl.
*H04R 25/00* (2006.01)

(52) U.S. Cl. ..... 381/324; 381/322; 381/328; 381/330

(58) Field of Classification Search ..... 381/322, 381/324, 327–328, 330, 380–381; 379/430; 181/129–135

See application file for complete search history.

(56) References Cited

U.S. PATENT DOCUMENTS

| | | | | |
|---|---|---|---|---|
| 3,197,576 | A | 7/1965 | Martin | |
| 5,887,070 | A | 3/1999 | Iseberg et al. | |
| 6,009,183 | A * | 12/1999 | Taenzer et al. | 381/330 |
| 7,027,608 | B2 * | 4/2006 | Fretz et al. | 381/330 |
| 7,110,562 | B1 * | 9/2006 | Feeley et al. | 381/322 |
| 7,522,743 | B2 * | 4/2009 | Dobras et al. | 381/381 |

FOREIGN PATENT DOCUMENTS

| | | | |
|---|---|---|---|
| JP | 2000300599 | | 10/2000 |
| WO | 99/07182 | | 2/1999 |
| WO | 01/69972 | A3 | 9/2001 |
| WO | 2004/025990 | A1 | 3/2004 |
| WO | 2004025990 | A1 | 3/2004 |
| WO | 2004112431 | A1 | 12/2004 |

* cited by examiner

*Primary Examiner*—Suhan Ni
(74) *Attorney, Agent, or Firm*—Pearne & Gordon LLP

(57) ABSTRACT

The present invention provides a hearing device comprising a first component (10) with a housing (11) comprising at least one electronic module, said housing (11) being adapted to be carried outside of or at the human body and a second component (20) to be inserted either partially or fully into an ear canal of a human body, said second component (20) comprising a shell (21). The hearing device further comprises connecting means connecting both mechanically and electrically said first and said second component (10;20), comprising a tube (30) with electric wire arranged within the tube (30) and two fasteners (31;32) being arranged at each end of said tube (30). Said first fastener (31), being adapted to detachably connect said second component (20) with said connecting means, comprises a receiving housing or compartment, adapted to contain at least a part of a receiver (23) to be placed within said second component (20). By providing a detachable fastener (31;32) at least at one end of the tube (30) acting as connecting means between the first and second component (10;20) of the hearing device, the connecting means may be easily detached from either the first or the second component (10;20) of the hearing device.

13 Claims, 6 Drawing Sheets

CONNECTOR SYSTEM FOR RECEIVERS OF HEARING DEVICES

TECHNICAL FIELD

This invention relates generally to hearing devices, hearing instruments or hearing aids and particularly to hearing devices with at least a first component to be arranged outside the ear or the ear canal respectively and a second component to be arranged in the ear or ear canal respectively, this second component comprising an output transducer to be connected to sound modules arranged within the first component.

BACKGROUND OF THE INVENTION

State of the art hearing devices are commonly either behind-the-ear (BTE) hearing devices, in-the-ear (ITE) hearing devices, in-the-canal (ITC) hearing devices or completely-in-the-canal (CIC) hearing devices. BTE hearing devices comprises sound conduction tubes to transmit the amplified sound from the BTE hearing device arranged behind the ear into the user's ear canal. The other hearing devices, ITE, ITC and CIC, are already arranged at or in the ear canal and thus have only short sound conduction tubes or no tubes at all.

Although the ITC and especially CIC hearing devices are preferred by many users due to their low visibility from outside, their drawbacks of limited maximum amplification, limited battery lifetime, limited receiver quality and not suitable space within the ear canal, also BTE hearing devices are still demanded and will still be used in the future.

In order to combine the advantages of BTE hearing devices and ITE, ITC and CIC hearing devices, combined hearing devices have already been proposed, comprising essentially two separate parts. The first part comprises most of the electronic modules, such as micro processors, tuners, power source, regularly in form of replaceable or re-chargeable batteries, and microphones, and is adapted to be worn externally by the user, either behind the ear or to be clipped to the clothing of the user. This part will be called the BTE part. The second part comprises an output transducer, regularly a speaker, and a shell, which is adapted or shaped to be worn partially or completely within the ear canal. This part will be called ITC or CIC part respectively. Those two parts are usually connected to each other by permanently wired connections.

In the field of hearing aids, the electric-to-acoustic transducer, regularly a speaker, is called receiver, as it will be done further on in this description.

Conventionally, the receiver is completely incorporated within the shell of said second ITC or CIC part and firmly connected to the electrical connectors. In case of failure or defect of the receiver, the whole ITC or CIC part has to be replaced, e.g. the shell and regularly also the connectors together with the defective receiver.

If the shell of this second part is custom shaped, a replacement of the receiver is therefore always coupled with a new manufacturing of a new custom shaped shell. That is a time consuming and costly process that may often only be performed by specialized fitting laboratories or the manufacturer of the hearing device. Time consuming means that the user will have to wait several days or even weeks until receiving a replacement part.

A modular connector system for auditory devices of the type of combined BTE/CIC is known from WO2004/025990.

The BTE-component of this earpiece auditory device is connected via a connector to the CIC-component comprising the receiver.

The connector consists of a hollow tube with electric wires within this tube. The connector is either hard wire coupled or detachably coupled to the receiver and thus to the CIC-component. The receiver is coupled to the shell of the CIC-component either by mean of a fastener or directly plugged into an opening of the shell. The shell may include an ear mold to be inserted into the ear canal of the user.

The fastener is either fixed to the shell by resilient snap-in tongues or by means of screws. The use of the resilient snap-in tongues allows an easy assembling of the fastener, but is only suitable if the shell of the CIC-component includes a soft ear mold, that may be squeezed to loosen the tongues for a non-destructive disassembling of the fastener and therefore of the connector. Such a fastening means is not suitable in case of rigid shells, as the fasteners may not be disassembled without breaking at least a part of the shell or the fastening means. In any case, this can only be done by specialists skilled in the art.

The use of detachable connecting means such as screws on the other hand requires a well-skilled and time-consuming assembling technique and further disturbs the regularly smooth shape of the outer surface of the housing of the CIC-component. Furthermore, the screws require a certain amount of space in its axial direction which is opponent to the requirement of miniaturization and reduces the freedom of design of the shape of the housing of the CIC-component. Thus, only a limited miniaturization is possible, as well as not all possible ear canal geometries may be covered by such a construction.

All those connecting means further suffer from being prone to contamination with wear debris, dust or humidity. Especially an electrical plug-in connection will thus decrease in its transmitting quality, if it is not securely sealed against such contamination.

SUMMARY OF THE INVENTION

It is an object of the present invention to provide an improved detachable connection between the two components of such a hearing device.

The present invention provides a hearing device comprising a first component with a housing comprising at least one electronic module, said housing being adapted to be carried outside of or at the human body; a second component to be inserted either partially or fully into an ear canal of a human body, said second component comprising a shell, further connecting means connecting both mechanically and electrically said first and said second component, said connecting means comprising a tube with electric wire arranged within the tube and two fasteners being arranged at each end of said tube; said first fastener, being adapted to detachably connect said second component with said connecting means, comprising a receiving housing or compartment, adapted to contain at least a part of a receiver to be placed within said second component.

By providing a detachable fastener at each end of the tube acting as connecting means between the first and second component of the hearing device, the connecting means may be easily detached from both the first and second component of the hearing device. As the first fastener, to be connected to the second component, contains the receiver, this receiver may be replaced without the need of replacing either the whole hearing device or at least the second component of the hearing device as well as the receiver itself.

In a further embodiment, the housing or compartment of said first fastener contains at least the part of said receiver comprising the electric connectors of said receiver.

Thus, the receiver is inserted into a compartment of the first fastener with its part containing the electrical connectors. Therefore, this part is fully covered and thus not prone to any external contamination. The electrical connectors may be electrically conducting surfaces apt to be soldered with electric wires or plugs or sockets.

In a further embodiment, said tube is a hollow tube with at least one end-to-end opened canal arranged within said tube. This canal may be used to guide the electric wires for the receiver or for the transmission of sound from an external source to the second component of the hearing aid. It is clear, that not only one canal may be arranged within said canal, but two or more canals may be arranged within said canal.

In a further embodiment, a solid wire is provided within said tube, said solid wire being firmly attached to both fasteners. Such a solid wire may act as a pull-out safety device preventing the tube from being bunked away from its fastener.

In a further embodiment, said tube is attached laterally parallel or under an acute angle with respect to the longitudinal axis of said receiver to a side of said first fastener. This reduces the axial force conferred to the connection of the tube to the fastener by pulling on the tube. Furthermore, the course of the tube protruding from the second component may be configured in any desired manner.

In a further embodiment, the end of said tube is arranged within a bore or opening provided within said housing of said first fastener. The end of the tube may thus be hold in a separate cavity of the first fastener, thereby reducing the risk of conferring any force from the tube directly to the receiver or to the connecting electrical wires.

In a further embodiment, said bore or opening is a dead-end with only one entry opening or is end-to-end opened. An advantage of an end-to-end opening is that an end-to-end open connection between the inside of the second component through the tube to the first component may be realized. This may be useful for the purpose of acoustical transmission or for ventilation purposes.

In a further embodiment, an elastic gasket is provided to seal the gap between a receiving opening of said first fastener and said receiver in the inserted position of receiver within first fastener. This elastic gasket may act as fastening mean for the receiver and/or as a sealing mean of the receiving cavity of said first fastener.

In a further embodiment, the length of said first fastener is about half the length of said receiver or less. That means that only half of the length of the receiver or even less is inserted into the receiving cavity of said first fastener. Thus, the overall length of said first fastener is relatively short and a high degree of miniaturization is therefore achieved.

In an alternative embodiment, said second component is an ITE-device having a faceplate and a shell connected to said faceplate.

In a further embodiment, an opening is provided in said faceplate for entering said first fastener into said shell of said ITE-device. The shape of this opening corresponds to the cross section of the fastener.

In a further embodiment, a cavity is provided at said faceplate arranged at the inside of said shell, either made as a part of said faceplate or as a separate part attached to said faceplate. The opening of the faceplate thus leads directly into said cavity. The cavity may be made by directly forming the inside of the faceplate respectively. Preferably, the shape of the cavity corresponds to the outer shape of the completed combination of the first fastener with inserted and connected receiver. Thus, the fully inserted first fastener and receiver will be firmly embedded by the walls of said cavity. Alternatively, it is possible to build said cavity by providing a separate shell, for instance made out of another material than the faceplate. Preferably, the material of the housing of said cavity is a soft and adaptable plastic material to elastically embedding said first fastener and receiver in its inserted state. This cavity has at its bottom end an opening or an open canal, acting as sound transmitting canal from the front end of the receiver to the inside of the ear opposite to the eardrum.

In a further embodiment, said first fastener comprises a multipart housing, comprising at least two half-shells attached to each other. The first fastener may be composed out of two half-shells that may be attached to each other to form the final housing of the first fastener.

In a further embodiment, said second component further comprises a detachable locking element for locking said first fastener in said second component. To prevent the first fastener to be pulled out of said second component, a fastener is provided to securely lock said first fastener within said second component. As this locking element is able to be detached, the first fastener may at any time be detached or replaced from said second component.

In a further embodiment, said locking element is a thin locking plate, to be arranged transversally to the insertion direction of the first fastener into said second component. A great advantage of having such a locking element is the fact, that due to its small thickness, the additional space needed in the insertion direction is only marginal and does practically not affect the overall length of said first fastener with receiver.

In a further embodiment, the locking plate has a rhombic shape, for instance with rounded edges at least at the smaller diameter of said plate, and has a rectangular opening arranged in its center. The opening may also be triangular, square, hexagonal or of any other shape suitable for turning said locking plate with a correspondingly shaped tool.

A first advantage of this shape of the locking plate is its easy but defined insertion position into the opening for the first fastener in the second component. As this opening will regularly have a rectangular shape, the locking plate may only be inserted in its unlocking alignment. The rounded edges will then allow a smooth turning of the locking element about around 45° in its locking position. The turning of the locking element may be performed by inserting the end of a screw driver into said rectangular slot. Thus, the locking and unlocking of the locking element may be quick and easily done without the need of having skilled knowledge.

In an alternative embodiment, the locking element is a pin, with truncated conically shaped ends. It has been found that the use of a pin, preferably with a small diameter, is as well usable for locking the first fastener within the second component of the hearing device. Furthermore, the pin in its locking position, lying crosswise within the opening of the second component, may be used as holding bar for any device or element to be attached to this bar. Thus, an element with ears formed by two resiliently arranged grippers, may be detachably clamped to the bar by sliding the ears over the bar.

In a further embodiment, a recess is provided at the back end of said first fastener to receive said locking element, having a shape that allows the locking element to be turned or swiveled around an axis perpendicular in relation to the surface of the back end of said first fastener. The locking element thus will on one hand be defined as it is positioned at the back end of said first fastener and on the other hand be defined during its rotation from the unlocked into the locked position.

In a further embodiment, a recess is arranged at a part of an inner wall arranged opposite to said locking element to receive end parts of the locking element in its locking position. The recess or recesses will receive the respective ends of the locking element, when the locking element is turned into its locking position. Therefore, the recesses are arranged at the inner wall within the turning plane of the locking element. Preferably, the width of those recesses is slightly lower than the thickness of the end parts of the locking element to be inserted into those recesses. The locking element will thereby be resiliently jammed in its locking position. A unintentional loosening of the locking element will thus be prevented.

In a further embodiment, the hearing device further comprises a covering plate covering the back end of said first fastener in its inserted state within said second component. The covering plate will close the opening provided for the first fastener and thereby providing a smooth and regular outer surface of the second component of the hearing device. This covering plate further prevents the inside of said opening of being contaminated by wear and dust.

In a further embodiment, said hearing device has tongues arranged at the inner side of the covering plate to resiliently be plugged into respective receiving bores arranged at the back end of said first fastener. To hold the covering plate in its covering position, the tongues are plugged into the bores by pressing onto the outside surface of the covering plate.

DESCRIPTION OF THE DRAWINGS

For purpose of facilitating and understanding the invention, some exemplary embodiments thereof are illustrated in the accompanying drawings to be considered in connection with the following description. Thus the invention may be readily understood and appreciated, but not limited to these embodiments.

DESCRIPTION OF A PREFERRED EMBODIMENT

Figure 1:
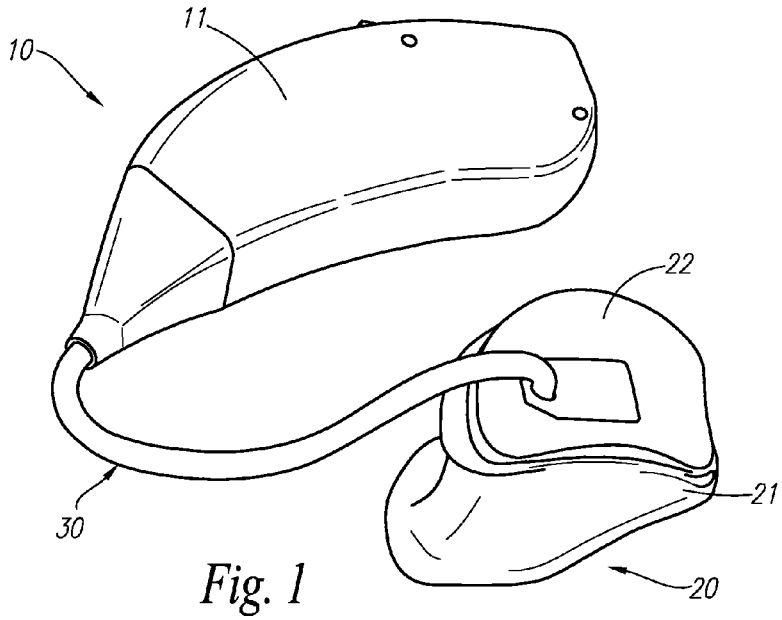
FIG. 1 is a view of an embodiment of an assembled hearing device according to the present invention.

Referring to FIG. 1, a first embodiment of a hearing device according to the present invention is shown in its assembled state. The hearing device comprises a BTE-device 10 (behind-the-ear) as a first component, an ITE-device 20 (in-the-ear) as a second component and a tube 30 as connecting means between the BTE-device and the ITE-device.

The BTE-device 10 has a housing 11 adapted to be worn behind the ear by the user and containing common electronic modules, such as a sound processing circuitry, microphone and battery.

The ITE-device 20 has a housing 21 adapted to be inserted into the outer part of the ear canal. The shape of housing 21 in this example is individually shaped to fit exactly into the ear shell and/or ear canal of an individual person. This is done by applying an individual fitting process by a specialized fitter. A faceplate 22 is arranged at the back end of housing 21, to receive the active components of ITE-device 20 and as well tube 30.

Figure 2:
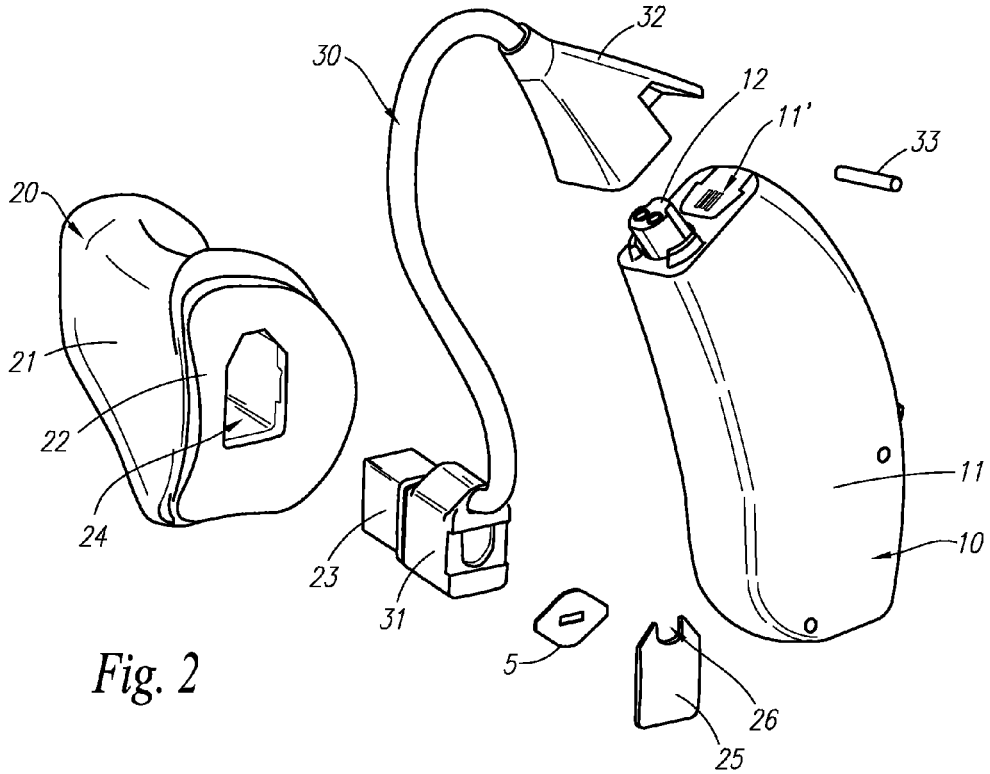
FIG. 2 is an exploded isometric view of the hearing device of FIG. 1.

FIG. 2 depicts an exploded isometric view of the hearing device of FIG. 1. Tube 30 has a first fastener 31 arranged at its left end and a second fastener 32 arranged at its right end. The second fastener 32 is adapted in its shape and functionality to be plugged onto the upper front 11' of housing 11 of BTE-device 10. The second fastener 32 will be secured to the housing 11 by a pin 33 which may be inserted through bores arranged transversally to the connecting direction in both the second fastener 32 and the connecting part 12 of housing 11.

The first fastener 31 is put over the back end of a receiver 23 of the ITE-device 20. The first fastener 31 together with the receiver 23 may be inserted into the inside of housing 21 of the ITE-device 20 through an opening 24 arranged in faceplate 22. A locking plate 5 is further provided to firmly hold first fastener 31 in its inserted position within ITE-device 20 or faceplate 22 respectively. The function of locking plate 5 will be more precisely described later in this description.

To cover and seal opening 24 of faceplate 22, a covering plate 25 is provided to be inserted over opening 24, having an aperture 26 for the lead through tube 30.

Figure 3:
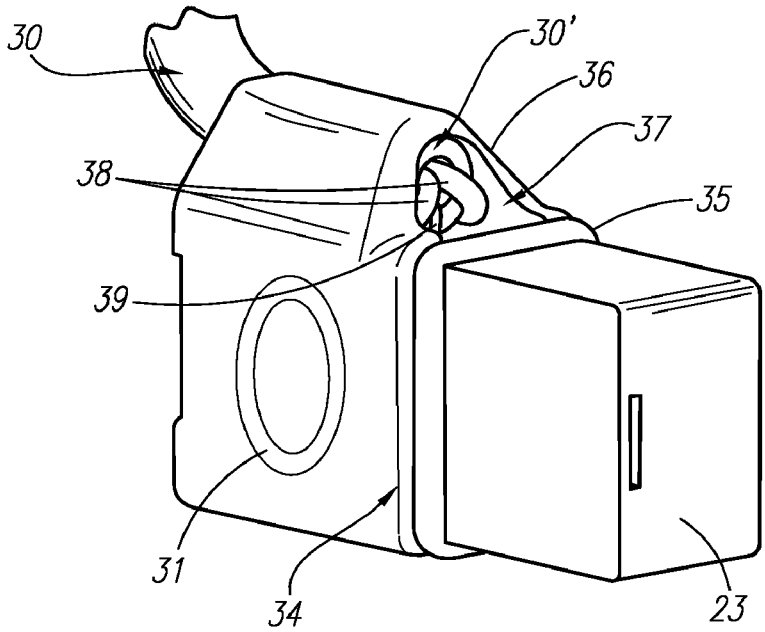
FIG. 3 is a front view onto the right-side of a fastener with inserted receiver of the embodiment of FIG. 1.
Figure 4:
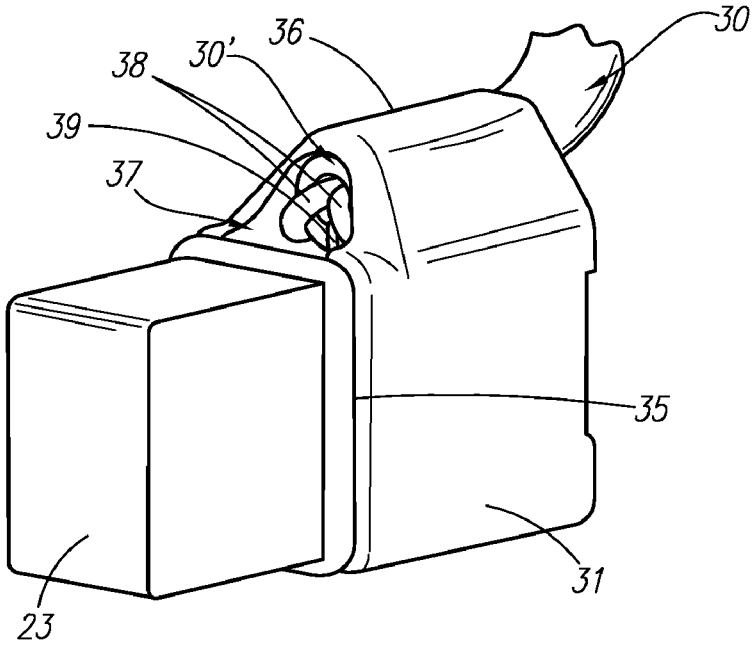
FIG. 4 is another front view onto the left-side of the fastener of FIG. 3.

The configuration of the first fastener 31 is more precisely depicted in the views of FIGS. 3 and 4. The first fastener 31 has for example a box-shaped housing with a front-opening 34 to receive receiver 23. Receiver 23 has for example a rectangular cuboid shape and may thus be pushed easily into said front-opening 34 of the first fastener 31. The depth of front-opening 34 is preferably equal or less than half of the length of receiver 23.

The edge of front-opening 34 may be equipped with an elastic gasket 35. This gasket 35 may on one side seal the gap between the surfaces of receiver 23 and first fastener 31 and on the other hand elastically clamp receiver 23 in its inserted state within fastener 31.

A bulge 36 is provided at the upper sidewall of the housing of first fastener 31 with a bore or opening 37 to receive the respective end 30' of tube 30.

By arranging this bore or opening 37 parallel to the longitudinal axis of opening 34 or receiver 23 respectively, the end 30' of tube 30 lies as well parallel to this longitudinal axis. This bore or opening 37 may be a dead-hole, only opened from the back side of first fastener 31, or opened on both sides.

For a communicative connection between the BTE-device 10 and the ITE-device 20, two electric wires 38 are arranged within tube 30 for establishing an electrical connection between receiver 23 and electronic components of the BTE-device 10. The ends of the electric wires 38 are bent around the end 30' of tube 30 and led to the interior back side of first fastener 31 to electric contacts arranged at the backside of receiver 23. The electric wires 38 may be soldered to those electric contacts or electrically connected in any other known manner.

The position of the end 30' of tube 30 may be secured by pressing, gluing or any other suitable connecting means within the bore or opening 37 of the housing of the first fastener 31. The end of an additional, solid wire 39, acting as a pull-out safety device, is additionally secured to the housing of first fastener 31, preferably within or close to the bore or opening 37.

This solid wire 39 runs for example together with the wires 38 within tube 30 from the first fastener 31 to the second fastener 32. Both types of wire 38 and 39 are preferably arranged within the hollow space of tube 30, but may be as well arranged within the wall of tube 30. Tube 30 may have a single open canal or multiple open canals arranged.

Figure 5:
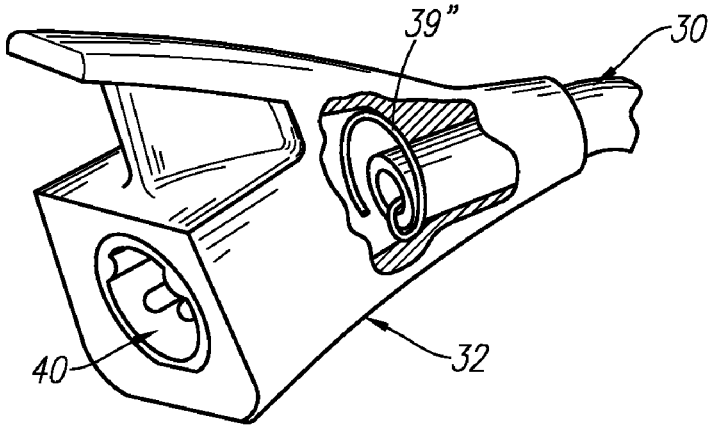
FIG. 5 is a front view onto a fastener to be connected to the BTE-part of FIG. 1.

The other end 39" of solid wire 39 is firmly attached to the housing of second fastener 32, to provide a reliable pull-out safety device for the whole tube 30, as shown in FIG. 5. For this purpose, the end 39" may be bent in form of a circle and be molded directly into the housing of second fastener 32.

An electric plug 40 is provided for the electric connection of the electric wires 38 (not shown in FIG. 5) with the electronic components of BTE-device 10. This plug 40 is plugged into a front bore arranged at the connecting side of second fastener 32.

Figure 6:
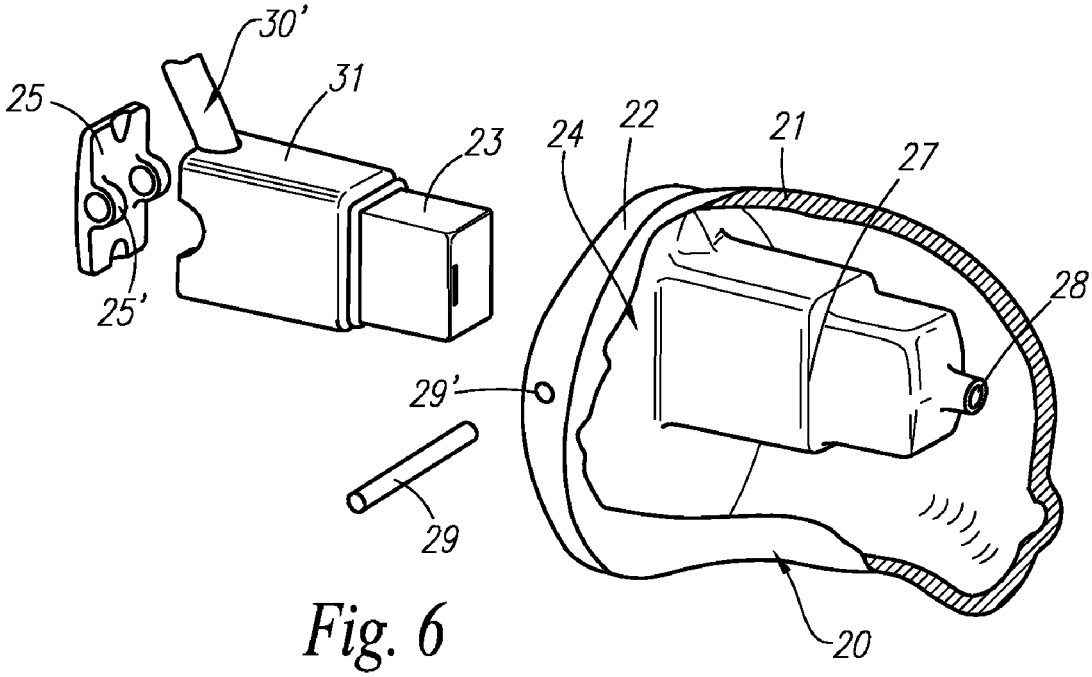
FIG. 6 is a partial exploded isometric view onto another embodiment of an ITE-part of a hearing device according to the present invention.

FIG. 6 depicts the view of a non assembled state of another embodiment of a first fastener 31 and ITE-device 20 according to the present invention. The ITE-device 20 comprises a faceplate 22 and a custom shaped housing 21 attached to faceplate 22. A (non-visible) opening 24 of faceplate 22 leads into a cavity 27 that protrudes into the inside of housing 21. Cavity 27 is designed to receive the first fastener 31 together with receiver 23 and has at its lower end a short tube 28 leading to a respective opening in the housing 21 to form an acoustic channel from receiver 23 into the user's ear canal.

The first fastener 31 may be inserted into said cavity 27 and the opening 24 of faceplate 22 will be closed by a covering plate 25, thereby holding and fixing fastener 31 and receiver 23 in its positions within faceplate 22. A pin 29 may be inserted through a bore 29' into faceplate 22 to fix covering plate 25 in its closed position in opening 24. Laterally protruding eyes 25' are provided at covering plate 25 for receiving said pin 29. A solid and stable detachable connection of the first fastener 31 to the faceplate 22 may thus be realized, wherein the fastening or locking means 29 is practically not visible from outside of the ITE-device 20.

As an alternative to the solution shown in FIGS. 2 to 4, the end 30' of tube 30 is not arranged parallel to the longitudinal axis of the first fastener 31, but enters the first fastener 31 under an acute angle.

Figure 7:
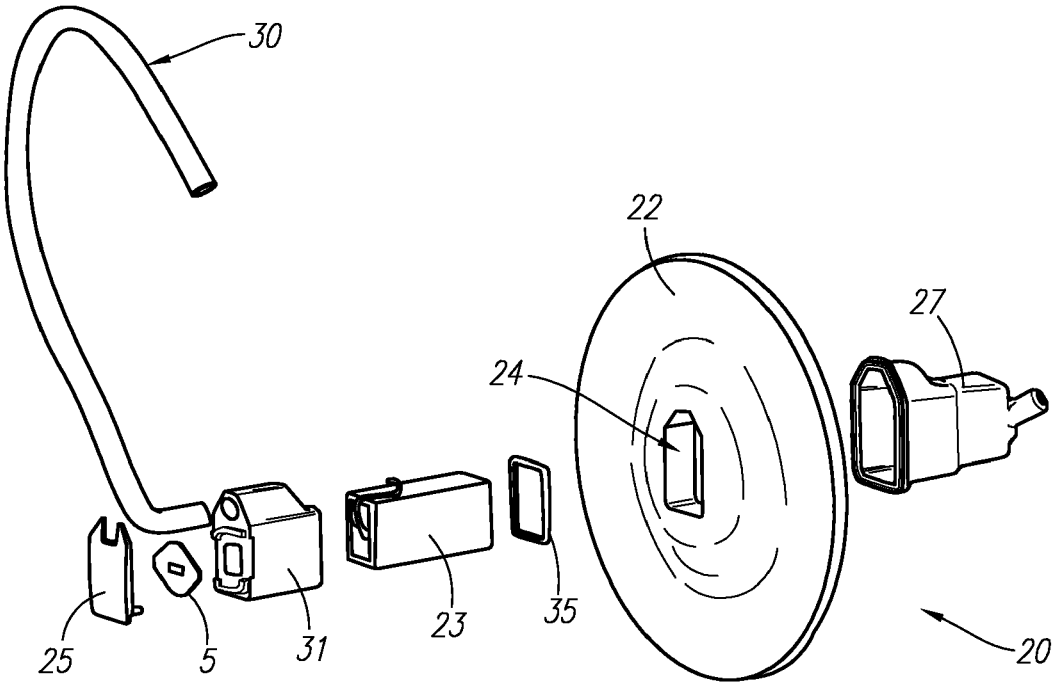
FIG. 7 is an exploded isometric view onto a further embodiment of an ITE-part of a hearing device according to the present invention.

In FIG. 7, the view of a further embodiment of a first fastener 31 and ITE-device 20 according to the present invention is shown. Alternatively to FIG. 6, cavity 27 is made as a hollow part separate from faceplate 22 and not as a one piece part. This part may for example be made out of plastic, for instance as a rigid or elastic mold.

Furthermore, the fixing of the first fastener 31 is realized by using a thin locking plate 5 that may be rotated within opening 24 of faceplate 22 to interlock into recesses arranged at the sidewalls in the region of the border area of opening 24. Covering plate 25 will thus only be used to cover opening 24 and locking plate 5 and provides a smooth and continuous shape of the outside surface of the first fastener 31 at the place of the entry of tube 30.

As already described, a gasket 35 may be provided to seal the gap between receiver 23 and first fastener 31. As can be seen out of FIG. 7, the length of first fastener 31 is about half of the length of receiver 23. By way of arranging the end 30' of tube 30 parallel to the longitudinal axis of first fastener 31 on one side of the housing of first fastener 31, a considerable amount of space may be saved compared to common solutions of straight entering the end 30' of the connecting tube 30 at the back end of receiver 23.

It will also be clear for the men skilled in the art that a defect receiver 23 may easily be removed and replaced by disassembling the few parts, without the need of replacing at the same time the shell of ITE-device 20. Thus, a considerable amount of time may be saved if such a replacement has to be performed.

Figure 8:
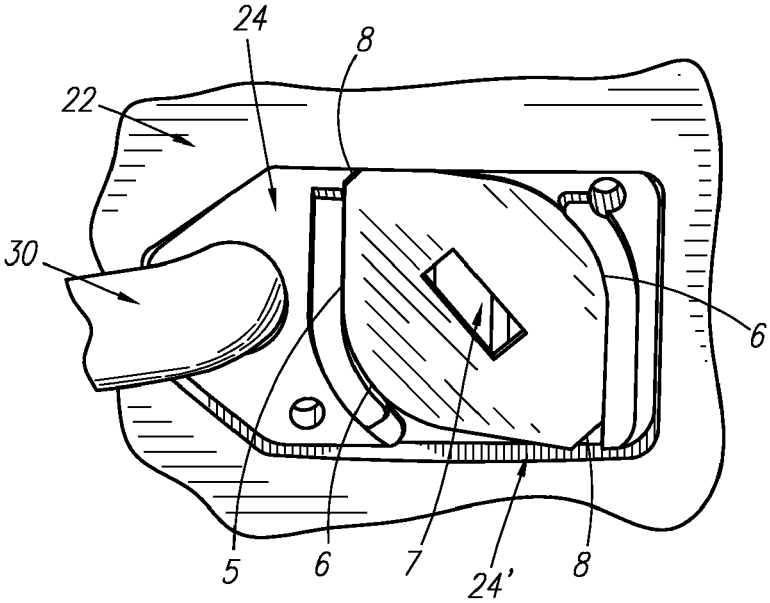
FIG. 8 is a partial view onto the backside of one embodiment of the ITE-part of a hearing device according to the present invention with a locking plate in its open position.

FIG. 8 depicts the front view into the opening 24 of faceplate 22 of an ITE-device 20 with the first fastener 31 already inserted. The back end of the first fastener 31 is positioned slightly below the outside edging of opening 24, with tube 30 protruding to the outside of faceplate 22. Locking plate 5 is applied into a recess 31' provided at the back end of first fastener 31.

Figure 9:
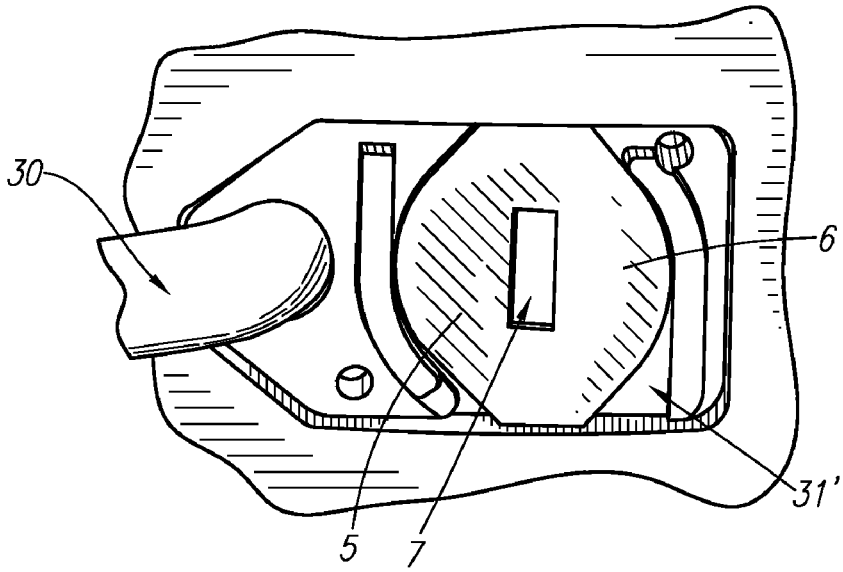
FIG. 9 is the same view as in FIG. 8 with the locking plate in its locked position.

The locking plate 5 has a rhombic shape with rounded edges 6 at least at the smaller diameter and has a rectangular opening 7 arranged in its center. Locking plate 5 may now be turned for example by using a screw-driver inserted into the rectangular opening 7 about 45°, thereby shifting its smaller edges 8 into grooves or recesses 24' arranged within the upper part of the sidewall of opening 24. The first fastener 31 is now detachably hold and fixed by locking plate 5 in its inserted state within faceplate 22, as shown in FIG. 9.

The recess 31' has a shape provided to guide locking plate 5 during the turning of locking plate 5 from the open to the locked position by guiding the rounded edges 6. Thus, no vertical guide or pin is necessary for holding locking plate 5 in its working position. Thus, the locking mechanism only needs space in its insertion direction in the amount of the thickness of locking plate 5.

Covering plate 25 may now be inserted above locking plate 5 to close opening 24 of faceplate 22. A rectangular shaped nose may be provided at the inner side of covering plate 25, adapted to be clamped into said rectangular opening 7 of locking plate 5. By using this configuration, neither the backside of first fastener 31 nor locking plate 5 is visible from the outside of ITE-device 20.

Furthermore, the use of a flat locking plate 5 reduces the amount of space needed for attaching the first fastener 31 within the ITE-device 20 particularly with respect to the longitudinal dimension of ITE-device 20. It is thus possible to provide an ITE-device 20 with minimal longitudinal dimension that may fit even for extremely convoluted shaped ear canals. It is clear that any other suitable attaching means may be provided at covering plate 25 to attach covering plate 25 with faceplate 22.

Figure 10:
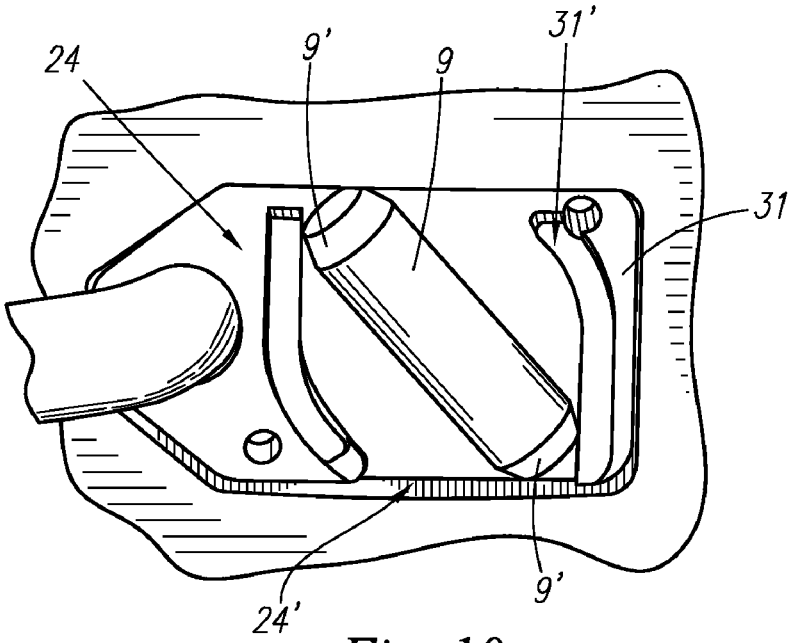
FIG. 10 is a partial view onto the backside of another embodiment of the ITE-part of a hearing device according to the present invention with a locking pin in its open position.
Figure 11:
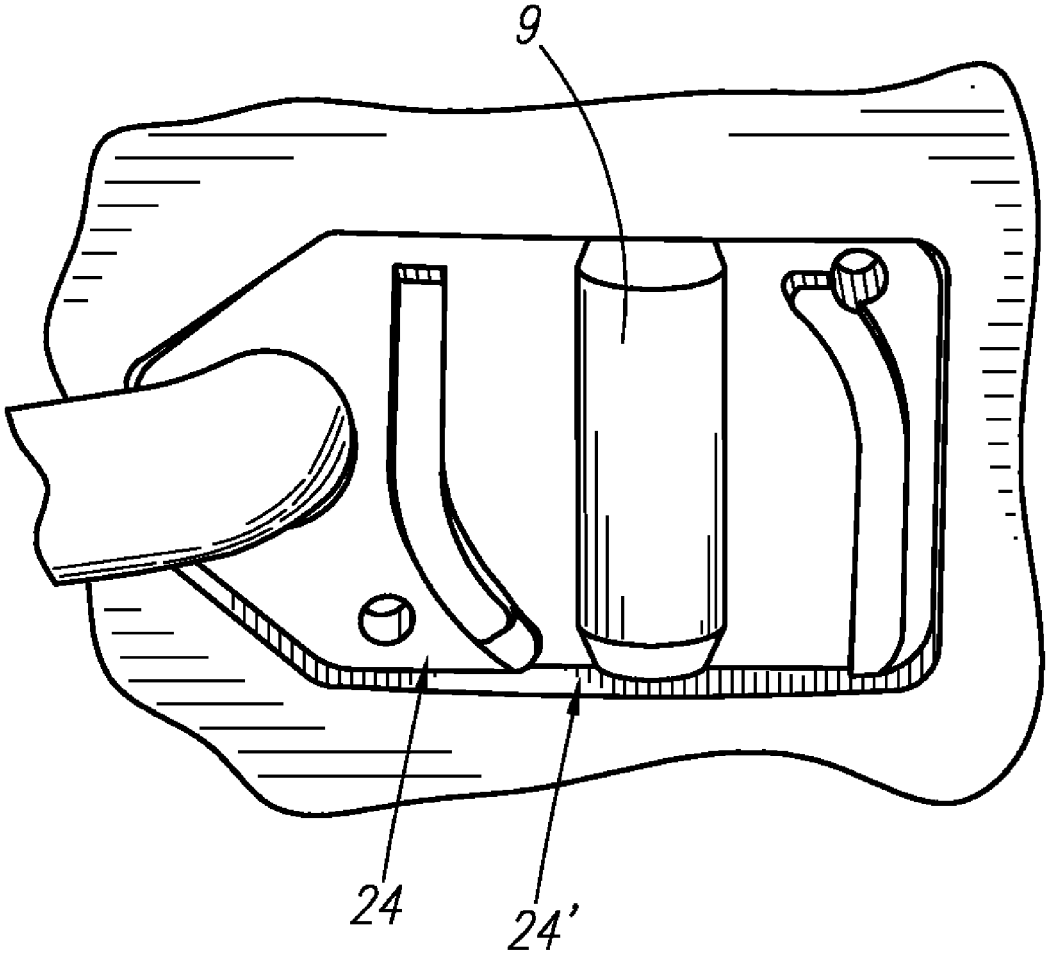
FIG. 11 is the same view as in FIG. 10 with the locking pin in its locked position.

Another embodiment of a locking device for locking the first fastener 31 within ITE-device 20 is shown in FIGS. 10 and 11. A locking pin 9 is used instead of a flat locking plate 5. This locking pin 9 has a generally cylindrical shape with truncated conical shaped ends 9'. It may be inserted in a crosswise position in relation to opening 24 into a circular shaped recess 31' arranged at the backside of first fastener 31. By twisting locking pin 9 for instance clockwise around the longitudinal axis of ITE-device 20, its ends 9' may engage into accordingly arranged grooves or recesses 24' arranged within the sidewall of opening 24. The first fastener 31 will thus be locked in its inserted position within ITE-device 20 and the opening 24 may be covered again by a covering plate 25 as already described.

It will be clear to one skilled in the art that other applications may be substituted for those set forth herein without departing from the spirit and scope of the present invention.

We claim:

1. A hearing device comprising:

a first component (10) with a housing (11) comprising at least one electronic module, said housing being adapted to be carried outside of or at the human body;

a second component (20) to be inserted either partially or fully into an ear canal of the human body, said second component (20) comprising a shell (21) and a faceplate (22) having a bore (29');

a connecting means connecting both mechanically and electrically said first component (10) and said second component (20), said connecting means comprising a tube (30) with electric wire (38) arranged within the tube (30) and two fasteners (31,32) arranged at each end of said tube (30);

a covering plate (25) including a first laterally protruding eye and a second laterally protruding eye; and a pin (29);

a first fastener (31) of said two fasteners (31, 32), being adapted to detachably connect said second component (20) with said connecting means, comprising a receiving housing or compartment, adapted to contain at least a part of a receiver (23) to be placed within said second component (20);

wherein the covering plate (25) covers a back end of the first fastener (31) while the first fastener (31) is in an inserted state within the second component (20), and wherein the pin (29) is insertable through the bore (29') of the faceplate (22) and through both of the first laterally protruding eye and the second laterally protruding eye of the covering plate (25) thereby holding the first fastener (31) in the inserted state within the second component (20).

2. Hearing device according to claim 1 wherein the housing or compartment of said first fastener (31) contains at least the part of said receiver (23) comprising the electric connectors of said receiver (23).

3. Hearing device according to claim 1 wherein said tube (30) is a hollow tube with at least one end-to-end opened canal arranged within said tube (30).

4. Hearing device according to claim 1, further comprising electric wires (38) and a solid wire (39) provided within said tube (30), said solid wire (39) being firmly attached to both fasteners (31,32) thereby forming a pull-out safety device.

5. Hearing device according to claim 1 wherein said tube (30) is attached laterally parallel or under an acute angle with respect to the longitudinal axis of said receiver (23) to a side of said first fastener (31).

6. Hearing device according to claim 5 wherein the end (30') of said tube (30) is arranged within a bore or opening (37) provided within said housing of said first fastener (31).

7. Hearing device according to claim 6 wherein said bore or opening (37) is a dead-end with only one entry opening or is end-to-end opened.

8. Hearing device according to claim 1 wherein an elastic rim (35) is provided to seal the gap between a receiving opening (34) of said first fastener (31) and said receiver (23) in the inserted position of said receiver (23) within said first fastener (31).

9. Hearing device according to claim 1 wherein the length of said first fastener (31) is about half the length of said receiver (23) or less.

10. Hearing device according to claim 1 wherein said second component (20) is an ITE-device, and said shell (21) is connected to said faceplate (22).

11. Hearing device according to claim 10 wherein an opening (24) is provided in said faceplate (22) for entering said first fastener (31) into said shell (21) of said ITE-device.

12. Hearing device according to claim 10 wherein a cavity (27) is provided at said faceplate (22) arranged at the inside of said shell (21), wherein said cavity is either made as a part of said faceplate (22) or as a separate part attached to said faceplate (22).

13. Hearing device according to claim 1 wherein said first fastener (31) comprises a multipart housing, comprising at least two half-shells attached to each other.

* * * * *